US011933557B2

(12) United States Patent
Admanit et al.

(10) Patent No.: US 11,933,557 B2
(45) Date of Patent: Mar. 19, 2024

(54) NON-LETHAL RIFLE

(71) Applicant: A.T. COBRA, Tzur Hadash (IL)

(72) Inventors: Tsuriel Admanit, Tzur Hadash (IL); Aryeh Odess, Asael (IL)

(73) Assignee: A.T. COBRA, Tzur Hadash (IL)

( * ) Notice: Subject to any disclaimer, the term of this patent is extended or adjusted under 35 U.S.C. 154(b) by 16 days.

(21) Appl. No.: 17/310,643

(22) PCT Filed: Feb. 13, 2020

(86) PCT No.: PCT/IB2020/051168
§ 371 (c)(1),
(2) Date: Aug. 13, 2021

(87) PCT Pub. No.: WO2020/165811
PCT Pub. Date: Aug. 20, 2020

(65) Prior Publication Data

US 2021/0389065 A1 Dec. 16, 2021

Related U.S. Application Data

(60) Provisional application No. 62/805,309, filed on Feb. 13, 2019.

(51) Int. Cl.
*F41B 11/00* (2013.01)
*F41A 1/04* (2006.01)
*F41A 1/06* (2006.01)

(52) U.S. Cl.
CPC . *F41A 1/06* (2013.01); *F41A 1/04* (2013.01)

(58) Field of Classification Search
CPC ..... F41B 11/62; F41B 11/723; F41B 11/71; F41B 11/724; F41A 1/04; F41A 1/06; F41A 19/03; F41A 19/58; F41G 1/473; F41C 23/22
USPC ..... 124/71, 73, 77, 76; 89/1.11, 1.1; 42/84
See application file for complete search history.

(56) References Cited

U.S. PATENT DOCUMENTS

| | | | | |
|---|---|---|---|---|
| 2,566,181 | A * | 8/1951 | Fitch | F41B 11/62 124/75 |
| 4,109,557 | A | 8/1978 | Zaucha | |
| 4,148,245 | A | 4/1979 | Steffanus et al. | |
| 4,729,319 | A | 3/1988 | Orlando | |
| 5,704,342 | A | 1/1998 | Gibson et al. | |
| 7,730,819 | B2 | 6/2010 | Lowell et al. | |
| 9,222,737 | B1 | 12/2015 | Lund et al. | |
| 2003/0024521 | A1* | 2/2003 | Smith | F41B 11/57 124/77 |
| 2003/0226555 | A1* | 12/2003 | Reible | F41B 11/52 124/73 |
| 2009/0199834 | A1 | 8/2009 | Skilling | |
| 2012/0132187 | A1* | 5/2012 | Murray | F41B 11/721 124/45 |
| 2013/0104868 | A1 | 5/2013 | Sikes | |

(Continued)

*Primary Examiner* — Michael D David
(74) *Attorney, Agent, or Firm* — Reches Patents

(57) ABSTRACT

A non-lethal rifle that may include a chamber, a barrel, a gas flow controller that is configured to release, following a trigger, a controllable amount of gas into the chamber; wherein the controllable amount of gas is determined based on, at least, information regarding a target; and an ignition unit that is configured to ignite the gas within a chamber thereby causing a controlled explosion that propels a non-lethal projectile through the chamber, the barrel and towards the target.

20 Claims, 2 Drawing Sheets

(56) References Cited

U.S. PATENT DOCUMENTS

| | | | |
|---|---|---|---|
| 2015/0108215 | A1 | 4/2015 | Ehrlich |
| 2016/0327360 | A1 | 11/2016 | Macy |
| 2017/0363383 | A1 | 12/2017 | Berger |

* cited by examiner

NON-LETHAL RIFLE

CROSS REFERENCE

This application claims priority from U.S. provisional patent 62/805,309 filing date Feb. 13, 2019.

BACKGROUND

U.S. Pat. Nos. 9,127,902, 8,833,352, 9,500,436, 9,328,989, 8,683,990 and 9,228,814 illustrates examples of non-lethal rifles.

The usage and especially the range of non-lethal rifles is limited due to the need not to kill the living target they hit.

There is a growing need to provide a non-lethal rifle that has a larger range without killing the living target they hit.

SUMMARY

There may be provided a non-lethal rifle that may include a chamber, a barrel, a gas flow controller that may be configured to release, following a trigger, a controllable amount of gas into the chamber; wherein the controllable amount of gas may be determined based on, at least, information regarding a target; and an ignition unit that may be configured to ignite the gas within a chamber thereby causing a controlled explosion that propels a non-lethal projectile through the chamber, the barrel and towards the target.

There may be provided a method for firing a non-lethal projectile, the method may include: (a) calculating a controlled amount of gas to be released by a gas flow controller, wherein the calculating may be based at least in part on information regarding a target; (b) sensing, a trigger for initiating a firing attempt; and (c) firing the non-lethal projectile. The firing may include (i) releasing by the gas flow controller, the controlled amount of gas into a chamber; and (ii) igniting the gas in the chamber thereby generating an explosion that propels the non-lethal projectile towards the target.

The information regarding the target may include a range of allowed impact on the target.

The information regarding the target may include information about one or more environmental parameters.

The information regarding the target may include spatial information.

The spatial information may include a distance from the non-lethal rifle and the target.

The spatial information may include a distance from the non-lethal rifle and the target, and angular relationship between the non-lethal rifle and the target.

The non-lethal rifle may include a controller that differs from the gas flow controller and may be configured to receive or generate the information regarding the target, and to determine the controllable amount of gas based on the information regarding the target.

The non-lethal rifle may include a distance measuring sight that may be configured to measure at least a distance to the target; wherein the distance to the target may be included in the information regarding the target.

The controller may be configured to determine the controllable amount of gas based at least in part, on success rates related to at least one of the (a) non-lethal rifle and, (b) a certain user of the non-lethal rifle.

The non-lethal rifle may include an inner space for receiving a gas cartridge that feeds the gas release mechanism with the gas.

The method may include receiving or generating, by a controller that differs from the gas flow controller, the information regarding the target; and determining the controllable amount of gas based on the information regarding the target.

The method may include measuring, by a distance measuring sight of the non-lethal rifle, at least a distance to the target; wherein the distance to the target may be included in the information regarding the target.

The determining of the controllable amount of gas may be also based, at least in part, on success rates related to at least one of the (a) non-lethal rifle and, (b) a certain user of the non-lethal rifle.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
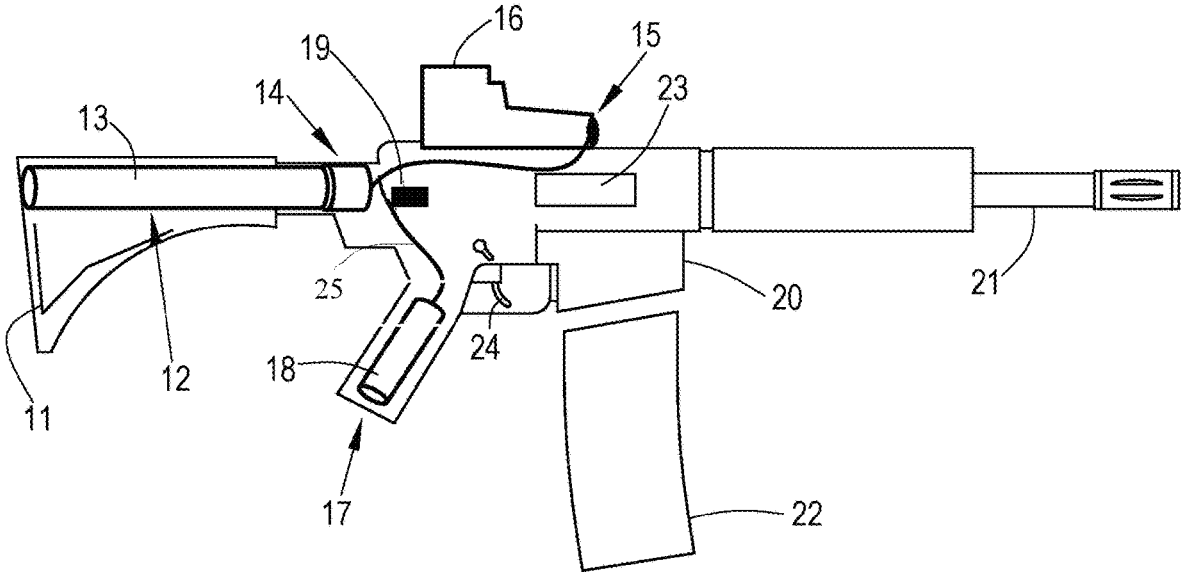
FIG. 1 illustrates an example of a non-lethal rifle.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference to a system should be applied mutatis mutandis to a reference to a method—and vice-verse.

There is provided a non-lethal rifle that includes:

a. A hollow stock 12 and a butt plate 11 that define a first inner space that can be selectively closed and opened.

b. A gas cartridge 13.

c. A gas flow controller such as a controlled gas valve 14.

d. A controller 15.

e. A distance measuring sight such as an electronic sight 16.

f. Grip 17 g. Battery 18 h. An ignition unit 19.

i. A magazine housing 20.

j. A barrel 21.

k. A chamber 23.

l. An electrical conductor 25 that may provide power from the battery 18 to the ignition unit and to the gas flow controller.

m. A trigger 24. Pressing the trigger initiates a firing of the ammunition.

FIG. 1 also illustrates a cartridge 22 of ammunition.

The gas cartridge may be inserted into the first inner space and then secured by the butt plate—or may be secured in any other manner.

The gas cartridge (when inserted in the first inner space) may be pressed against a controlled gas valve or otherwise fluidly coupled to the controlled gas valve. The gas cartridge may be punctured during the process.

The controlled gas value may emit a controlled amount of gas to a chamber, wherein a firing of an ammunition involves igniting the emitted gas by the ignition unit thereby generating, within the chamber, a controlled explosion that propels the ammunition through the chamber, the barrel and towards the target.

A magazine that include non-lethal ammunition—such as a gas filled ammunition may be inserted into the magazine housing.

The controlled gas value may be controlled by a controller.

The controller may receive spatial information regarding a target—such as the distance to the target and/or the angular relationship between the non-lethal rifle and the target.

The controller may determine, in response to the spatial information, one or more firing parameters that may control the firing of non-lethal ammunition from the non-lethal rifle.

The one or more firing parameters may include the controlled amount of gas to be released from the controlled gas valve.

The relationship between the spatial information and the amount of gas can be learnt during a learning period, can be calculated and can be determine in any manner.

The controller may be configured to determine the controlled amount of gas in response to other parameters—for example a limit on the impact (for example—below a certain threshold such as 23 Joule).

Accordingly—the controlled amount of gas may be determined based multiple parameters including the spatial information, a limit on the impact, and the like.

A parameter may be one or more environmental parameters such wind within a space between the non-lethal rifle and the target, rain, fog, dust, and the like.

A parameter may be a remaining amount of gas in the gas cartridge—for example allocating enough gas to reach the target but with a lower impact—when the gas cartridge is relatively empty (or have the amount of gas go below a certain threshold—such as 5, 10, 15, 20, 25 percent fullness of the gas cartridge).

A parameter may include the previous success rates related to the non-lethal rifle and/or to a certain user of the non-lethal rifle. For example—a less accurate user may require more attempts and thus should be allocated less gas—assuming that the ammunition still reaches the target.

It should be noted that the amount of gas may be responsive to the estimated projection of the ammunition—especially which changes in the amount of gas can cause the ammunition to miss the target. For example if the ammunition is expected to hit the middle of the chest of the target at an angle of about 80 degrees—then the amount of released gas may be changed (according to parameters other than the spatial information) by a certain amount. A smaller amount of change may be introduced when the ammunition is expected to hit the head of the target and at a steeper angle.

The electronic sight may include a display that displays the target and may also display information related to the target—such as the spatial information. The electronic sight may transmit visual information to a display that does not belong to the non-lethal rifle. The display may be worn by a user, be positioned remotely from the non-lethal rifle, positioned in proximity to the non-lethal rifle, and the like.

The electronic sight may also provide suggestion regarding the manner (for example orientation) to hold the non-lethal rifle. The electronic sight may, for example, calculate expected deviations of the ammunition based on a movement of the target and the direction and/or velocity of ambient wind.

The non-lethal rifle may include a recording unit that may record the output generated by the electronic sight or any other information related to any firing attempt. The recording unit may record the information for a certain period—such as a week or more. The recording unit may record the information on any media—volatile or non-volatile, magnetic, optical, and the like.

The non-lethal rifle may include a communication unit that may communicate with other devices—for example may output any information related to the non-lethal rifle and/or any firing attempt. The communication unit may be a wireless communication unit such as but not limited to a radio frequency wireless communication unit, an infrared wireless communication unit, or any other communication unit.

The non-lethal rifle may include a power source (such as rechargeable battery) for powering the electrical sight, and the like.

The power source may be inserted, for example in the grip of the non-lethal rifle.

There may be provided a method for firing non-lethal ammunition.

Figure 2:
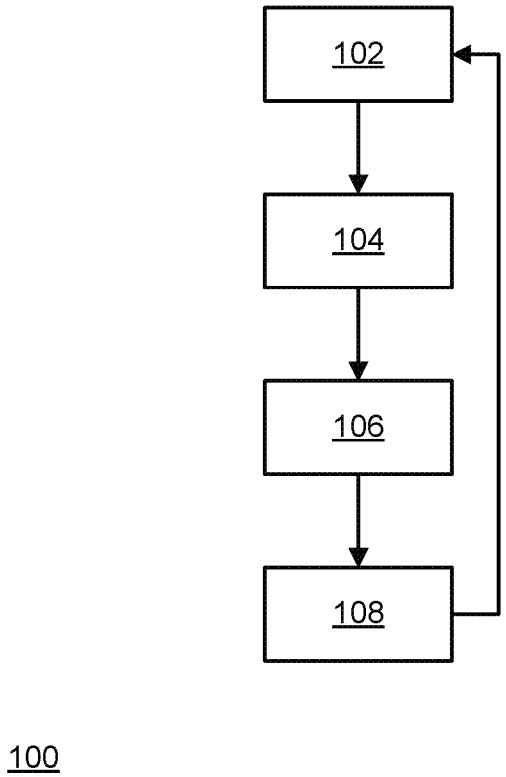
FIG. 2 illustrates an example of a method.

The method (denoted 100 in FIG. 2) may include acquiring (102) a target and calculating spatial information.

Calculating (104) a controlled amount of gas to be released by a gas flow controller such as a controlled gas valve, the calculating is based at least in part on a safety rule and/or on the spatial information. Sensing (106), that a user pressed the trigger to initiate a firing attempt. Firing (108) the ammunition—the firing includes releasing by the gas flow controller the controlled amount of gas into a chamber, igniting the gas in the chamber thereby generating an explosion that propels the ammunition towards the target. The method may include recording the firing attempt, sending information regarding the firing attempt- and the like.

In the foregoing specification, the invention has been described with reference to specific examples of embodiments of the invention. It will, however, be evident that various modifications and changes may be made therein without departing from the broader spirit and scope of the invention as set forth in the appended claims.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A non-lethal rifle, comprising:

a chamber;

a barrel;

a gas flow controller that is configured to release, following a trigger, a controllable amount of gas into the chamber; wherein the controllable amount of gas is determined based on, at least, information regarding a target; and an ignition unit that is configured to ignite the gas within the chamber thereby causing a controlled explosion that propels a non-lethal projectile through the chamber, the barrel and towards the target; and wherein the information regarding the target comprises a distance from the non-lethal rifle and the target, and an angular relationship between the non-lethal rifle and the target.

2. The non-lethal rifle according to claim 1 comprising a controller that differs from the gas flow controller and is configured to receive or generate the information regarding the target, and to determine the controllable amount of gas based on the information regarding the target.

3. The non-lethal rifle according to claim 2 comprising a distance measuring sight that is configured to measure at least a distance to the target; wherein the distance to the target is included in the information regarding the target.

4. The non-lethal rifle according to claim 2 wherein the information regarding the target comprises a range of allowed impact on the target.

5. The non-lethal rifle according to claim 2 wherein the information regarding the target comprises information about one or more environmental parameters.

6. The non-lethal rifle according to claim 2 wherein the information regarding the target comprises spatial information.

7. The non-lethal rifle according to claim 6 wherein the spatial information comprises a distance from the non-lethal rifle and the target.

8. The non-lethal rifle according to claim 6 wherein the spatial information comprises the distance from the non-lethal rifle and the target, and the angular relationship between the non-lethal rifle and the target.

9. The non-lethal rifle according to claim 2 wherein the controller is configured to determine the controllable amount of gas based at least in part, on a success rate related to the non-lethal rifle.

10. The non-lethal rifle according to claim 1 comprising an inner space for receiving a gas cartridge that feeds the gas flow controller.

11. The non-lethal rifle according to claim 2, comprising a distance measuring sight and a recording unit that is configured to record an output of the distance measuring sight.

12. The non-lethal rifle according to claim 2, comprising a distance measuring sight and a recording unit that is configured to record information related to any firing attempt, the information differs from an output of the distance measuring sight.

13. The non-lethal rifle according to claim 2, comprising a distance measuring sight that is configured to calculate expected deviations of the ammunition based on a movement of the target and at least one of a direction of a velocity of ambient wind.

14. The non-lethal rifle according to claim 1, wherein the information regarding a target comprises remaining amount of gas in the gas cartridge.

15. The non-lethal rifle according to claim 2, wherein the controller is configured to determine the controllable amount of gas based which changes in an amount of gas can cause the ammunition to miss the target.

16. The non-lethal rifle according to claim 2, comprising a distance measuring sight that is configured to provide suggestion regarding a manner to hold the non-lethal rifle.

17. The non-lethal rifle according to claim 2, comprising a distance measuring sight that is configured to provide suggestion regarding an orientation of a held non-lethal rifle.

18. The non-lethal rifle according to claim 2, wherein the controller is configured to allow a certain amount of change of an amount of gas when the ammunition is expected to hit a middle of a chest of the target at an angle of about 80 degrees, and to allow a smaller amount of change when the ammunition is expected to hit a head of the target and at a steeper angle.

19. The non-lethal rifle according to claim 2, wherein the controller is configured to determine the controllable amount of gas based at least in part, on a success rate related to a user of the non-lethal rifle.

20. The non-lethal rifle according to claim 2, wherein the controller is configured to determine the controllable amount of gas based at least in part, on a success rate related to a user of the non-lethal rifle and to a success rate related to the non-lethal rifle.

* * * * *